United States Patent [19]

Hüppi

[11] Patent Number: 5,048,141

[45] Date of Patent: Sep. 17, 1991

[54] FLOOR-CLEANING MACHINE WITH IMPROVED BRUSH PRESSURE CONTROL

[76] Inventor: Karl Hüppi, Brunnenstrasse 1B, CH-9542 Munchwilen, Switzerland

[21] Appl. No.: 503,607

[22] Filed: Apr. 3, 1990

[30] Foreign Application Priority Data

Apr. 3, 1989 [GB] United Kingdom ..... 8907481

[51] Int. Cl.[5] ..... A47L 11/162

[52] U.S. Cl. ..... 15/49.1; 51/177

[58] Field of Search ..... 15/49.1, 50.1, 50.2, 15/50.3, 52.1,.52.2, 98, 383, 384, 385; 51/176, 177

[56] References Cited

U.S. PATENT DOCUMENTS

| | | | |
|---|---|---|---|
| 3,436,788 | 4/1969 | Tamny | 15/340.4 |
| 4,674,142 | 6/1987 | Meili | 15/49.1 |
| 4,729,141 | 3/1988 | Berg et al. | 15/49.1 |
| 4,731,956 | 3/1988 | Wood | 51/177 |

FOREIGN PATENT DOCUMENTS

| | | |
|---|---|---|
| 2153518 | 5/1973 | Fed. Rep. of Germany . |
| 1345932 | 10/1963 | France . |
| 2054365 | 2/1981 | United Kingdom . |

*Primary Examiner*—Edward L. Roberts

*Attorney, Agent, or Firm*—Cushman, Darby & Cushman

[57] ABSTRACT

An automatic floor-cleaning and floor-treating machine having improved brush-pressure control. The machine includes a body which is supported on wheels and a frame which is pivotally mounted with respect to the body. At least one rotating brush is mounted on one lateral side of the frame with respect to the pivot axis. The other lateral side of the frame with respect to the pivot axis is connected to one end of a spring. The other end of the spring can be displaced by operation of a motor. A second spring is provided which is connected at one end to the displaceable end of the first spring and at the other end to the frame on the side where the rotating brush is mounted. Preferably, the attachment site of the first spring to the second spring is connected to the actuator arm of a servomotor.

3 Claims, 1 Drawing Sheet

FLOOR-CLEANING MACHINE WITH IMPROVED BRUSH PRESSURE CONTROL

The present invention relates to a floor-cleaning machine and in particular to an automatic floor-cleaning and -treating machine which can be used for cleaning carpets and hard surfaces of large floor areas, such as in hotels, factories, office buildings, shopping centers and the like.

Such a floor-cleaning machine is known in the art and is for instance described in the European patent application 173,394. It comprises a body which is supported on wheels and two rotating brushes which are driven by an electrical motor.

The body contains reservoirs for storing fresh and spent cleaning liquid, means for dosing fresh cleaning liquid on to the floor and a battery, pump and motor. The machine is moved around by means of two electrically driven wheels in front and steered by means of one or more steering wheels at the rear.

The rotatable brushes are mounted on one end of a pivotable frame. The other side of the frame, beyond the center of rotation, is connected to one end of a spring, which is extendable by means of a motor. The brush pressure on the floor is proportional to the spring tension and can thus be varied by actuating the motor.

It is important that the brush pressure on the floor can be regulated or varied, because various types of floors and floors having different amounts of soil would require a different approach. For instance, a large brush pressure on a lightly soiled floor would cause excessive wear of the floor and of the brushes and other machine parts, while it would also lead to an excessive energy consumption as a result of the large frictional forces. On the other hand, if the brush pressure is too light, unacceptable cleaning results may be obtained on heavily soiled surfaces.

We have now found that an improved variable pressure brush control can be provided by the floor-cleaning and floor-treating machine according to the present invention, which is characterized in that there is provided a second spring which is connected at one end to the displaceable end of the first spring, and at the other end to the frame where the rotating brushes are mounted.

Preferably, the attachment site of the first spring to the second spring is connected to the actuator arm of a servomotor.

In an especially preferred embodiment, the actuator arm of the servomotor near its fully extended position runs up with the frame, such that upon further extending the actuator arm the frame will be pivoted and the rotating brushes will be lifted off the floor.

The invention will now be explained in detail by means of the following specific descriptions in which:

FIG. 1 schematically illustrates as a preferred embodiment of the invention a detail of a floor-cleaning and -treating machine having its rotating brushes lifted off the floor;

Figure 1:
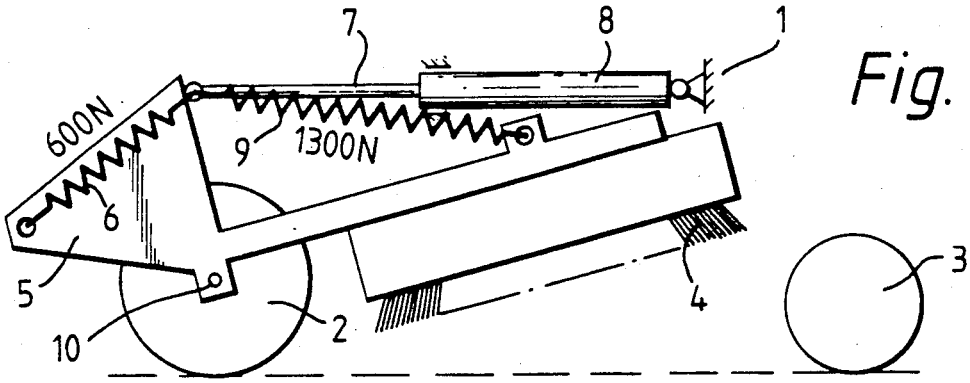

FIG. 1 shows a detail of a floor-cleaning and -treating machine according to the invention in a schematical way. For the sake of clarity, only the vital parts are depicted; the body, the reservoirs, etc. are not shown. The figure does show the main driving wheels 2 and the steering wheels 3 on which the body 1 of the floor-cleaning machine is supported, and a rotating brush 4 which is mounted on a frame 5. This frame can be pivoted relative to the body of the machine upon an axis 10, which in the depicted situation coincides with the central axis of the two main driving wheels 2. The other side of the frame, i.e. the side where the brushes are not mounted, is connected to one end of a tension spring 6. The other end of the spring 6 is connected to an actuator arm 7 of a servomotor 8, which is attached to the body of the floor-cleaning machine. The actuator arm 7 of the servomotor is also connected to a second tension spring 9. This second spring is connected at its other end to the frame, near the place where the rotating brushes are mounted on the frame.

In FIG. 1, the actuator arm of the servomotor is shown in its fully extended position. It has run up with the frame and has pushed it away, thereby pivoting it around the center of rotation 10. The rotating brushes 4 have thereby been lifted off the floor. The tension in the first spring is now minimal; in the second spring it is maximal.

Figure 2:
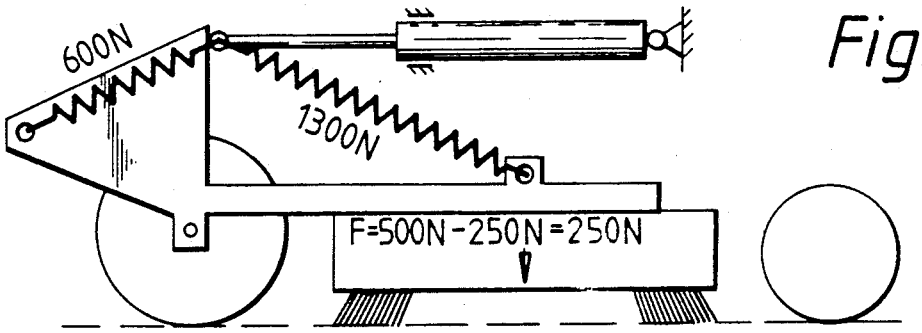
FIG. 2 illustrates the same machine with its brushes lowered on to the floor under a light downward pressure.
Figure 3:
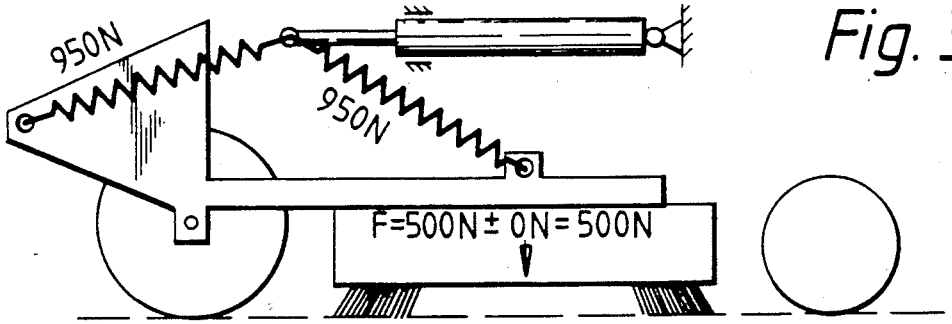
FIG. 3 illustrates the same machine with its brushes lowered on to the floor under a medium downward pressure.
Figure 4:
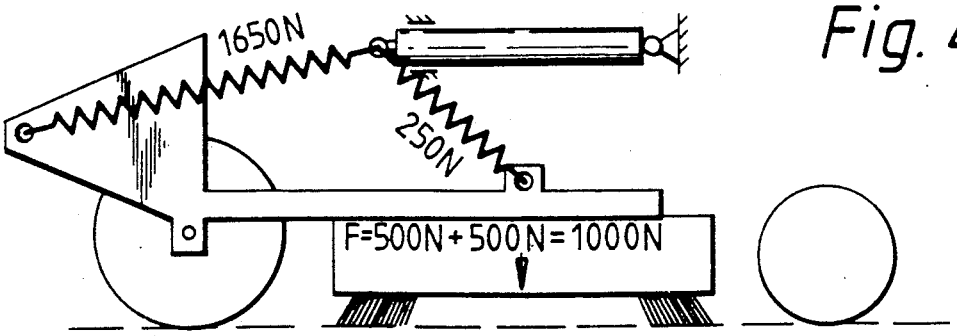
FIG. 4 illustrates the same machine with its brushes lowered on to the floor under a high downward pressure.

When the servomotor is now operated, the actuator arm 7 is gradually retracted (FIGS. 2–4). First, the frame will be pivoted until the brushes just come into contact with the floor. At that stage, the downward pressure of the rotating brushes on the floor will be negligible and the cleaning action will be minimal. Upon further retracting the actuator arm, the first spring will now be stretched while the second spring will be relaxed. The resultant down-pressure of the brushes on the floor, which equals the vertical component of the vector summation of the tension forces in the two springs, is thereby gradually increased until a maximal value is reached (see FIG. 4). By way of example, some numerical data on the tension strength in the respective springs are also given in the figures.

It can be seen that, owing to this construction, the down-pressure of the rotating brushes can be easily varied and regulated over a broad range, which is determined by the dimensions and relative orientations of the respective springs. This means that a flexible approach is offered to the different situations encountered in floor cleaning, each requiring a different optimal brush pressure.

According to the present invention, the downward brush pressure can be particularly well regulated in the range between zero pressure and the weight exerted by the mass of the brush assembly. The motor for lifting the brushes off the floor only needs to cope with the difference between the tension in the first and the second spring and can accordingly be dimensioned smaller than in the known floor-cleaning machines which have only one spring. Thus an important economical advantage is achieved in the manufacturing of the floor-cleaning machines according to the invention.

It will be understood that instead of the two tension springs 6 and 9 shown in FIG. 1, also a combination of two or more identical or different spring means can be envisaged, without departing from the scope of the present invention.

The servomotor 8 to be used according to the present invention can be any type of known servomotor which translates a given input signal, such as an electrical signal, into a preferably linear displacement of its actuator arm.

The servomotor 8 can be operated from the control panel by means of a suitable conventional controlling circuit. It can also be controlled by a feed-back circuit in which the current is measured through the main motor driving the rotational brushes, using a preset value which is entered at the control panel.

I claim:

1. Automatic floor-cleaning and floor-treating machine comprising:

a machine body having wheels supporting the same with respect to a floor;

a frame pivotally mounted to said machine body so as to be pivotable about a pivot axis;

at least one rotating brush mounted to a first lateral side of said frame with respect to said pivot axis;

a first spring means having first and second ends, said first end of said first spring means being coupled to said frame on a second lateral side of the frame with respect to said pivot axis;

a motor coupled to said second end of said first spring means, said motor being mounted to said machine body so as to selectively displace said second end of said first spring means with respect to said pivot axis; and a second spring means having first and second ends, said first end of said second spring means being coupled to said second end of said first spring means and said second end of said second spring means being mounted to said frame on the same lateral side thereof as said at least one rotating brush.

2. Automatic floor-cleaning machine as in claim 1, wherein said motor is a servomotor having an actuator arm, said second end of said first spring means and said first end of said second spring means being coupled to said actuator arm.

3. Automatic floor-cleaning machine according to claim 2, wherein said actuator arm of said servomotor engages said frame prior to reaching a fully extended position thereof whereby full extension of said actuator arm pivots said frame about said pivot axis so as to lift said at least one rotating brush off the floor.

* * * * *